US005258734A

United States Patent [19]

Tamai et al.

[11] Patent Number: 5,258,734

[45] Date of Patent: Nov. 2, 1993

[54] BEAM DEFLECTOR FOR A CATHODE RAY TUBE

[75] Inventors: Hisashi Tamai, Tokyo; Shigemi Oguchi, Kanagawa, both of Japan

[73] Assignee: Sony Corporation, Tokyo, Japan

[21] Appl. No.: 832,958

[22] Filed: Feb. 10, 1992

[30] Foreign Application Priority Data

Feb. 12, 1991 [JP] Japan ..... 3-005195[U]

[51] Int. Cl.[5] ..... H01F 5/02

[52] U.S. Cl. ..... 335/213; 335/210

[58] Field of Search ..... 335/213, 210, 211, 212, 335/214

[56] References Cited

U.S. PATENT DOCUMENTS 4,096,462 6/1978 Akatsu et al. ..... 335/213
4,484,166 11/1984 Osinga et al. ..... 335/213

FOREIGN PATENT DOCUMENTS 0232948 8/1987 European Pat. Off. .
57-151155 9/1982 Japan .
61-214336 9/1986 Japan .
2-155151 6/1990 Japan .

*Primary Examiner*—Harold Broome
*Attorney, Agent, or Firm*—Lewis H. Eslinger; Jay H. Maioli

[57] ABSTRACT

A deflection yoke for a cathode ray tube is provided with two separated winding portions, a first portion provided around the neck portion and the tapered portion from the neck to the screen of the cathode ray tube has a uniform and circular winding distribution and a second portion close to the screen of the picture tube has a non-uniform winding distribution and is elongated in the x-axis direction to provide a pin cushion magnetic field without adversely affecting the focus.

4 Claims, 4 Drawing Sheets

BEAM DEFLECTOR FOR A CATHODE RAY TUBE

BACKGROUND OF THE INVENTION

This invention relates to a beam deflector for use with a cathode ray tube.

Magnetic deflection is normally used in cathode ray tubes such as television picture tubes or the like having an electric gun provided to emit electrons toward a fluorescent screen. It is the common practice to deflect an electron beam in a cathode ray tube by a deflection yoke provided around the neck portion of the cathode ray tube. The deflection yoke has a coil portion wound to have a uniform thickness so as to produce a uniform magnetic field deflecting the electron beam in the cathode ray tube. The uniform magnetic field provides a good beam-focusing performance; however, it tends to cause picture distortion at and near the edges of the screen of the cathode ray tube. In order to correct the picture distortion, the deflection yoke has another coil portion wound to have a non-uniform thickness so as to produce a pincushion magnetic field for deflecting the electron beam in the cathode ray tube. However, the pincushion magnetic field tends to degrade the beam-focusing performance. Therefore, the conventional beam deflector cannot correct the picture distortion to a sufficient degree without the significant sacrifice of the beam-focusing performance.

SUMMARY OF THE INVENTION

Therefore, a main object of the invention is to provide an improved beam deflector which can correct the picture distortion to a sufficient extend and maintain the beam-focusing performance without significant sacrifice.

There is provided, in accordance with the invention, a beam deflector for deflecting an electron beam in a cathode ray tube having a screen and a neck portion positioned in rear of the screen. The beam deflector comprises a deflection coil provided around the neck portion of the cathode ray tube for producing a deflecting magnetic field. The deflection coil has a front end close to the screen, a first portion wound except for the front end to produce a uniform magnetic field and a second portion wound at the front end to produce a pincushion magnetic field.

In another aspect of the invention, the beam deflector comprises a deflection yoke mounted around the neck portion of the cathode ray tube. The deflection yoke has a front end close to the screen and includes horizontal and vertical deflection coils. At least one of said horizontal and vertical deflection coils has a first portion wound to have a uniform thickness substantially over the full length of the deflection yoke so as to produce a uniform deflecting magnetic field in the neck portion and a second portion wound to have a non-uniform thickness at the front end so as to produce a pincushion deflecting magnetic field.

In still another aspect of the invention, the beam deflector comprises a deflection yoke mounted around the neck portion of the cathode ray tube. The deflection yoke includes a bobbin having a deflection coil wound thereon for producing a deflecting magnetic field in the neck portion. The bobbin has a front end close to the screen and a front flange formed at the front end of the bobbin. The deflection coil has a first portion wound to have a uniform thickness on the bobbin except for the front flange so as to produce a uniform magnetic field and a second portion wound to have a non-uniform thickness on the front flange so as to produce a pincushion magnetic field.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 6:
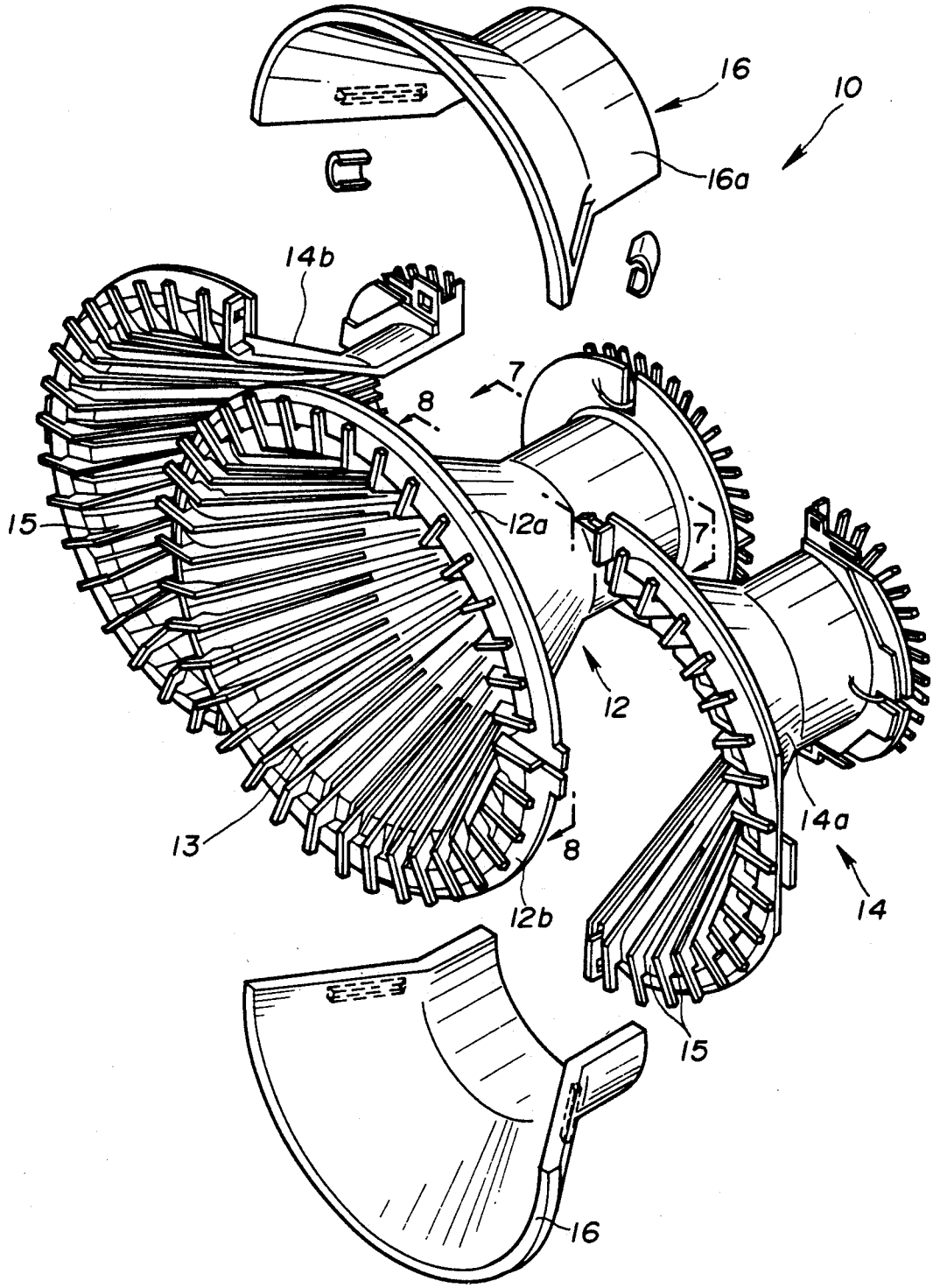
FIG. 6 PRIOR ART
FIG. 6 is an exploded perspective view showing a conventional deflection yoke.
Figure 7:
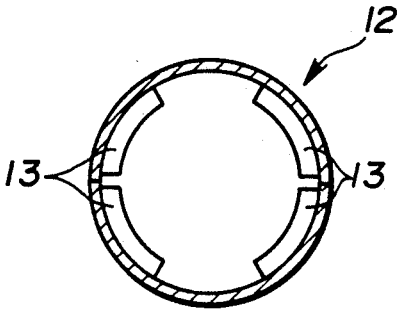
FIG. 7 PRIOR ART
FIG. 7 is a sectional view taken along the lines a—a of FIG. 6.
Figure 8:
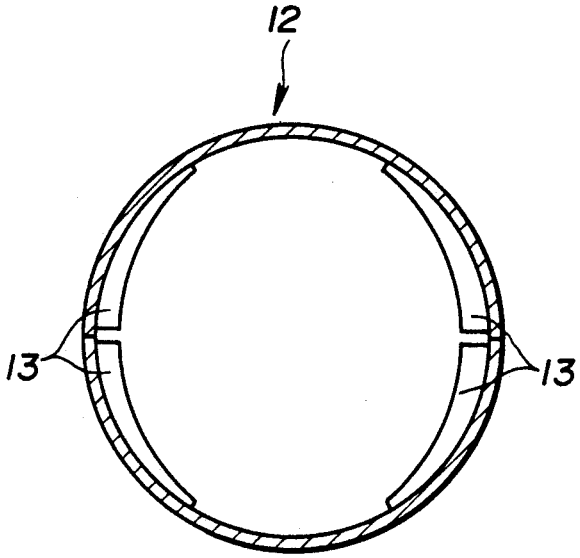
FIG. 8 PRIOR ART
FIG. 8 is a sectional view taken along the lines b—b of FIG. 6.

Prior to the description of the preferred embodiment of the present invention, the prior art deflection yoke of FIGS. 6–8 is briefly described in order to specifically point out the difficulties attendant thereon.

The prior art deflection yoke 10 of FIG. 6 is of a saddle shape including an inner wire wound bobbin 12 mounted around the neck portion of a cathode ray tube (not shown), an outer wire wound bobbin 14 mounted around the inner wire wound bobbin 12, and a core 16 composed of two core parts **16*a* and 16*b* interconnected to cover the outer periphery of the outer wire wound bobbin 14. The inner bobbin 12 is composed of two interconnected bobbin parts 12*a* and 12*b* and it has a cylindrical rear portion having a rear opening defined by an annular rear end flange, and a diverging front portion extending away from the cylindrical rear portion toward the fluorescent screen (not shown) of the cathode ray tube. The diverging front portion has a front opening defined by an annular front end flange. The front opening is greater in diameter than the diameter of the rear opening. A conductor is wound and supported on the inner surface of the inner bobbin 12 to form a horizontal deflection coil 13. The horizontal deflection coil 13 produces a horizontal deflection magnetic field to deflect the electron beam horizontally in the neck portion of the cathode ray tube when energized. Similarly, the outer bobbin 14 is composed of two bobbin parts 14*a* and 14*b* interconnected to cover the outer periphery of the inner bobbin 12. A conductor is wound and supported on the inner surface of the outer bobbin 14 to form a vertical deflection coil 15. The vertical deflection coil 15** produces a vertical deflection magnetic field to deflect the electron beam vertically in the neck portion of the cathode ray tube when energized.

Figure 9:
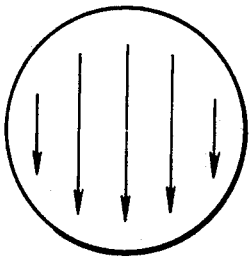
FIG. 9 is a diagram showing a deflecting magnetic field produced in the section of FIG. 7.
Figure 10:
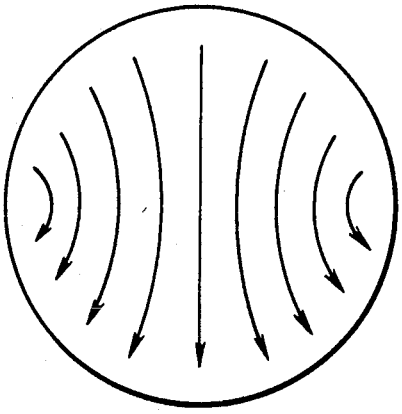
FIG. 10 is a diagram showing a deflecting magnetic field produced in the section of FIG. 8.

The horizontal deflection coil 13 has a first portion wound to have a uniform thickness on the cylindrical rear portion, as shown in FIG. 7. This first portion will produce a uniform magnetic field in the cathode ray tube, as shown in FIG. 9. Although such a uniform magnetic field is effective to provide a good beam-focusing performance, it will cause picture distortion on and near the edge of the screen of the cathode ray tube. In order to correct the picture distortion, the horizontal deflection coil 13 has a second portion wound to have a non-uniform thickness on the diverging front portion, as shown in FIG. 8. This second portion will produce a pincushion magnetic field in the cathode ray tube, as shown in FIG. 10. However, the pincushion magnetic field will produce forces to deform the electron beam into a squeezed shape so as to degrade the beam-focusing performance. For this reason, the prior art deflection yoke cannot correct the picture distortion to a sufficient degree without the significant sacrifice of the beam-focusing performance.

Figure 1:
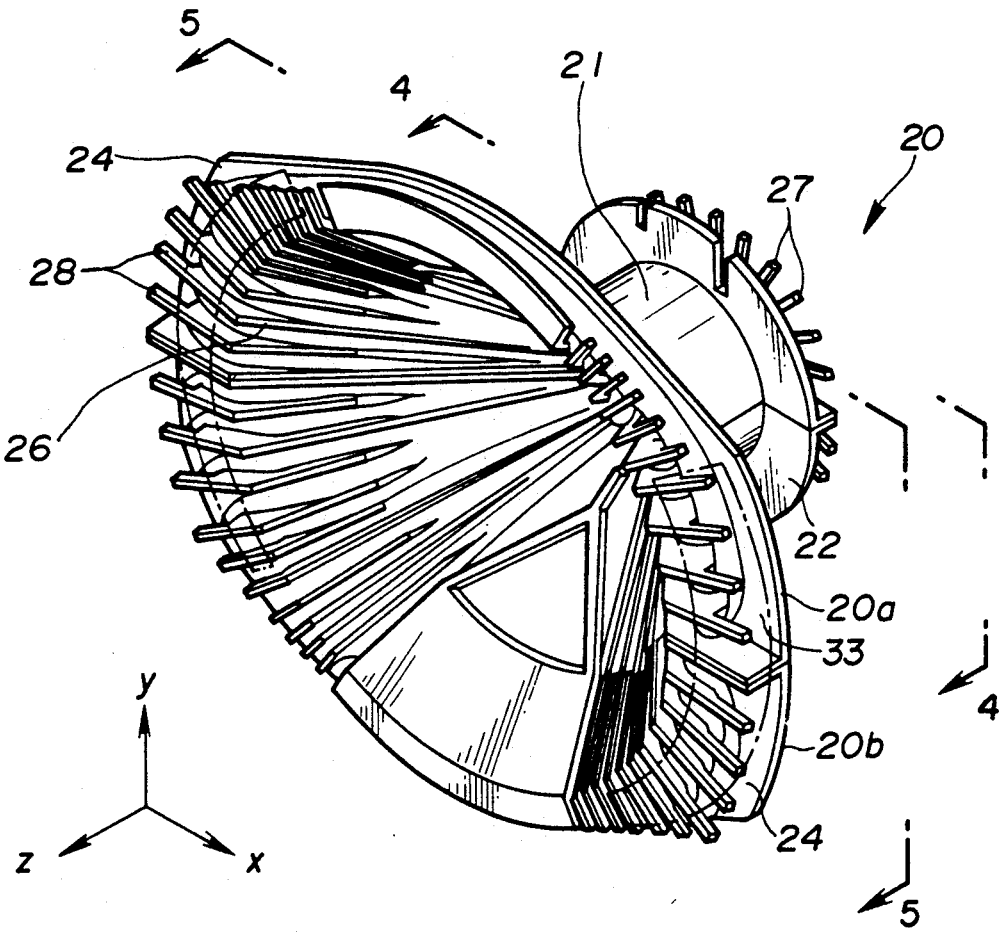
FIG. 1 is a partially cutaway perspective view showing an inner wire wound bobbin embodying the invention.
Figure 2:
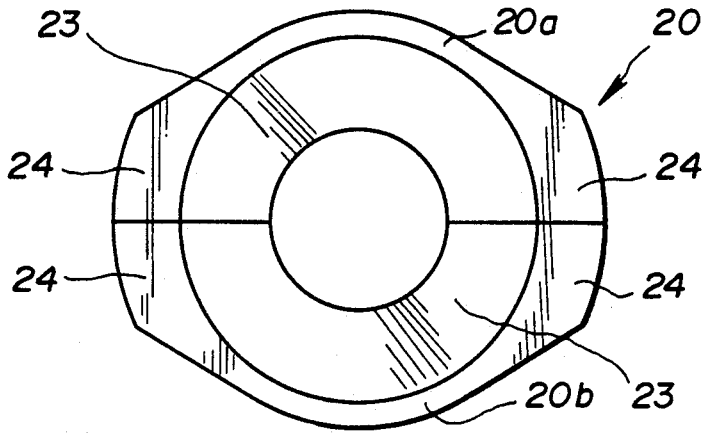
FIG. 2 is a schematic elevational view of the wire wound bobbin of FIG. 1.
Figure 3:
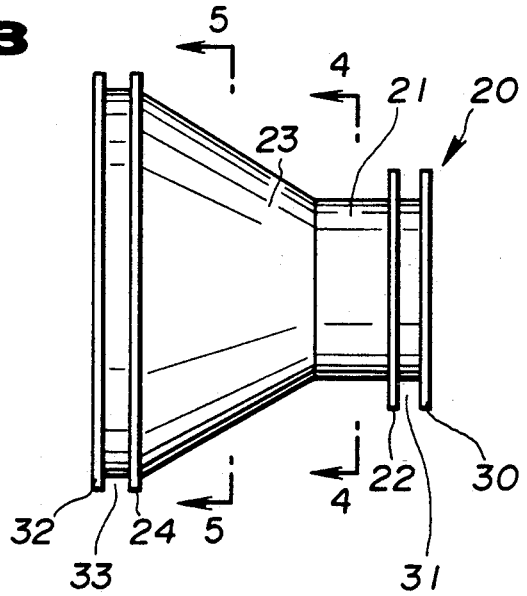
FIG. 3 is a schematic side view of the wire wound bobbin of FIG. 1.

Referring to FIGS. 1 to 3, there is shown a beam deflector embodying the invention. The beam deflector is taken in the form of a deflection yoke having an inner wire wound bobbin 20. The inner wire wound bobbin 20 includes two interconnected bobbin parts 20*a* and 20*b*. The inner bobbin 20 has a cylindrical rear portion 21 and a diverging front portion 23 extending away from the cylindrical rear portion 21 toward the fluorescent screen (not shown) of the cathode ray tube. The cylindrical rear portion 21 is formed at its rear end with an annular rear flange 22 which defines a rear opening. The diverging front portion 23 is formed at its front end with a front flange 24 which defines a front opening greater in diameter than the diameter of the rear opening. The front flange 24 is elongated in the x-direction (horizontal direction) to provide a horizontal length longer than the vertical length of the front flange 24, as best shown in FIG. 2.

Figure 4:
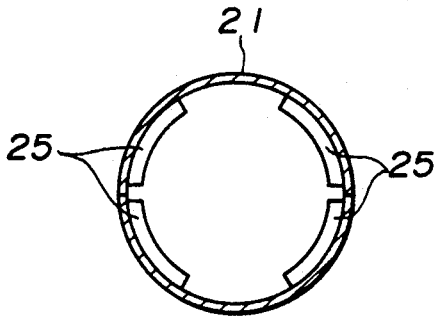
FIG. 4 is a sectional view taken along the lines A—A of FIG. 3.
Figure 5:
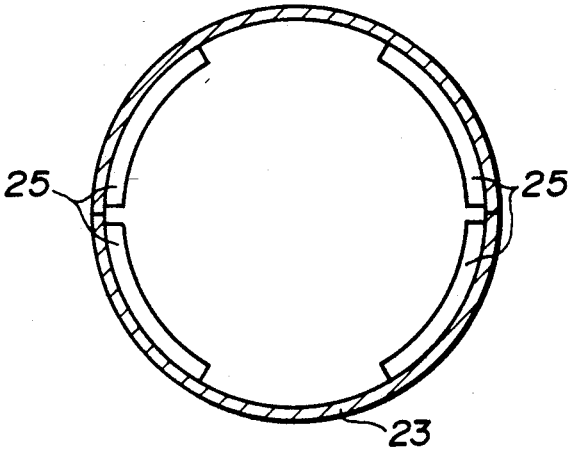
FIG. 5 is a sectional view taken along the lines B—B of FIG. 3

A conductor is wound to produce a horizontal deflection coil 25 which has a first portion wound to have a uniform thickness (x-direction) on the inner bobbin 20 to produce a uniform magnetic field in the cathode ray tube when energized. The first portion of the horizontal deflection coil 25 expands substantially over the full length (z-direction) of the inner bobbin 20. That is, the horizontal deflection coil 25 has a uniform thickness substantially over the full length of the cylindrical rear portion 21. FIG. 4 shows the uniform thickness of the horizontal deflection coil 25 in the section taken along the lines A—A of FIG. 3. The horizontal deflection coil 25 has a uniform thickness substantially over the full length of the diverging front portion 23 of the inner bobbin 20. FIG. 5 shows the uniform thickness of the horizontal deflection coil 25 in the section taken along the lines B—B of FIG. 3. The horizontal deflection coil 25 also has a second portion wound to have a non-uniform thickness (x-direction) on the front flange 24 so as to produce a pincushion magnetic field when energized. The thickness, that is, the x-direction length, of the second portion of the horizontal deflection coil 25 decreases going away from the line at which the inner bobbin parts 20*a* and 20*b* are connected.

A number of guide projections 26 are formed in spaced relation to each other on the inner surface of the inner bobbin 20. Each of the guide projections 26 has a rear hook projection 27 formed on the rear surface of the rear flange 22 and a front hook projection 28 formed on the front surface of the front flange 24. A rear annular wall 30 is provided on the rear hook projections 27 to form grooves 31 for receipt of a number of turns of the horizontal deflection coil 25. Similarly, a front wall 32 is provided on the front hook projections 28 to form grooves 33 for receipt of a number of turns of the horizontal deflection coil 25.

The other part of the deflection yoke is substantially the same as described in connection with FIG. 6 and will not be described further.

It is apparent from the foregoing that the beam deflector of the invention includes a deflection coil 25 which produces a deflecting magnetic field to deflect the electron beam in the cathode ray tube. The deflection coil has a first portion wound to have a uniform thickness substantially over the full length of the deflection coil so as to produce a uniform magnetic field when energized and a second portion wound to have a non-uniform thickness only at the front end of the deflection coil so as to produce a pincushion magnetic field. Thus, the electron beam emitted from the electron gun toward the screen is subject first to the influence of the uniform magnetic field produced by the first portion of the deflection coil and then to the influence of the pincushion magnetic field produced by the second portion of the deflection coil. Under the influence of the uniform magnetic field, the electron beam is deflected without any shape deformation. The pincushion magnetic field is effective to correct the picture distortion caused by the influence of the uniform magnetic field. The pincushion magnetic field tends to deform the shape of the electron beam. The degree to which the electron beam is deformed is dependent on the distance of the screen from the position at which the electron beam is subject to the influence of the pincushion magnetic field. Since the second portion is positioned only at the front end of the deflection coil, that is, at a position as close to the screen of the cathode ray tube as possible, the deflection coil of the invention is effective to correct the picture distortion to a sufficient extent and maintain the beam-focusing performance without significant in focusing sacrifice.

Although the invention has been described in connection with a deflection coil having a second portion extending in the x-direction to have a non-uniform thickness, it is to be understood that the second portion is not limited to this arrangement as long as it can produce a pincushion magnetic field at the front end of the deflection coil. Although the invention has been described in connection with the inner wire wound bobbin of the deflection yoke, it is to be noted the invention is equally applicable to the outer wire wound bobbin of the deflection yoke to correct picture distortion at or near the left and right edges of the screen of the cathode ray tube while maintaining the beam-focusing performance without significant sacrifice.

While the invention has been described in connection with a specific embodiment thereof, it is evident that many alternatives, modifications and variations will be apparent to those skilled in the art. Accordingly, it is intended to embrace all alternatives, modifications and variations that fall within the scope of the appended claims.

What is claimed is:

1. A beam deflector for deflecting an electron beam in a cathode ray tube having a screen, a neck portion positioned at a rear of said screen, and a divergent, transition portion between said neck portion and said screen, said beam deflector comprising a deflection coil provided around said neck portion and said transition portion of said cathode ray tube for producing a deflecting magnetic field, said deflection coil having a first portion of uniform thickness wound on said neck portion and on said transition portion to produce a uniform magnetic field and a second portion of non-uniform thickness wound at front end of said deflection coil close to said screen to produce a pincushion magnetic field.

2. A beam deflector for deflecting an electron beam in a cathode ray tube having a screen, a neck portion positioned at a rear of said screen, and a divergent transition portion between said neck portion and said screen, said beam deflector comprising a deflection yoke mounted around said neck portion and said transition portion of said cathode ray tube, said deflection yoke having a front end close to said screen, said deflection yoke including horizontal and vertical deflection coils, at least one of said horizontal and vertical deflection coils having a first portion wound to have a uniform thickness substantially over a full length of said deflection yoke so as to produce a uniform deflecting magnetic field in said neck portion and said transition portion and a second portion would to have a non-uniform thickness at said front end of said deflection yoke close to said screen so as to produce a pincushion deflecting magnetic field.

3. A beam deflector for deflecting an electron beam in a cathode ray tube having a screen, a neck portion positioned behind said screen, and a divergent transition portion between said neck portion and said screen, said beam deflector comprising a deflection yoke mounted around said neck portion and said transition portion of said cathode ray tube, said deflection yoke including a bobbin having a deflection coil wound thereon for producing a deflecting magnetic field in said neck portion and said transition portion, said bobbin having a front end close to said screen and a front flange formed at said front end of said bobbin, said deflection coil having a first portion wound to have a uniform thickness on said bobbin at said neck portion and said transition portion of said cathode ray tube to produce a uniform magnetic field and a second portion wound to have a non-uniform thickness on said front flange close to said screen so as to produce a pincushion magnetic field.

4. The beam deflector as claimed in claim 3, wherein said bobbin has a diverging front portion formed at said front end with said front flange, said front flange being elongated in a horizontal direction to have a horizontal length longer than a vertical length, so as to be substantially oval shaped.

* * * * *